US005415523A

United States Patent [19]

Müller

[11] Patent Number: 5,415,523

[45] Date of Patent: May 16, 1995

[54] CONTROL SYSTEM FOR VARIABLE-PITCH BOAT PROPELLER

[76] Inventor: Peter Müller, Isengrund 9, CH-8134 Adliswil, Switzerland

[21] Appl. No.: 126,172

[22] Filed: Sep. 23, 1993

[30] Foreign Application Priority Data

Sep. 23, 1992 [DE] Germany ..... 42 31 815.7

[51] Int. Cl.[6] ..... B63H 3/08

[52] U.S. Cl. ..... 416/35; 416/48; 416/157 R

[58] Field of Search ..... 416/25, 30, 35, 44, 416/47, 48, 156, 157 R; 92/162 R

[56] References Cited

U.S. PATENT DOCUMENTS

| | | | |
|---|---|---|---|
| 2,722,985 | 11/1955 | Biermann | 416/48 |
| 3,273,656 | 9/1966 | Bird | 416/157 R |
| 3,589,830 | 6/1971 | Mogren et al. | 416/35 |
| 4,058,360 | 11/1977 | Hirschberger . | |
| 4,156,584 | 5/1979 | Schuck | 92/162 R |
| 4,419,059 | 12/1983 | Williams . | |
| 4,645,420 | 2/1987 | Warner . | |
| 5,061,212 | 10/1991 | Morgenthaler et al. | 416/30 |
| 5,209,640 | 5/1993 | Moriya | 416/35 |

FOREIGN PATENT DOCUMENTS

| | | | |
|---|---|---|---|
| 0280639 | 8/1988 | European Pat. Off. . | |
| 2261174 | 9/1975 | France . | |
| 1137339 | 9/1962 | Germany . | |
| 47773 | 8/1966 | Germany . | |
| 1922565 | 11/1969 | Germany . | |
| 3938567 | 4/1991 | Germany . | |
| 3901137 | 4/1992 | Germany . | |
| 162999 | 5/1921 | United Kingdom | 415/47 |

*Primary Examiner*—Edward K. Look
*Assistant Examiner*—James A. Larson
*Attorney, Agent, or Firm*—Herbert Dubno; Andrew Wilford

[57] ABSTRACT

A marine drive has a propeller rotatable about a drive axis and having a plurality of blades themselves pivotable about respective blade axes projecting generally radially from the drive axis and each movable between a low-pitch end position extending generally parallel to a plane perpendicular to the drive axis and a high-pitch end position extending at a large acute angle to the plane. An engine rotates the propeller about the drive axis at a variable drive speed in a forward rotation direction. The blade axes are so positioned relative to the respective blades that on forward rotation of the propeller the blades are urged into one of their end positions. A single-acting hydraulic actuator connected to the blades has a compartment pressurizable to displace the blades into the other of the end positions. A source of fluid under pressure has a high-pressure side connected to a controller that is also connected to the compartment and that compares actual engine speed with a desired engine speed and for pressurizing the compartment from the high-pressure side of the source when the actual engine speed varies to one side of the desired engine speed. A conduit connected between the low-pressure side of the source and the compartment continuously drains the compartment to the low-pressure side of the source.

9 Claims, 1 Drawing Sheet

CONTROL SYSTEM FOR VARIABLE-PITCH BOAT PROPELLER

FIELD OF THE INVENTION

The present invention relates to a boat drive with a variable-pitch propeller. More particularly this invention concerns a control system for such a propeller.

BACKGROUND OF THE INVENTION

A standard boat drive has an engine and a variable-pitch propeller rotated by the engine about a drive axis that is the same as the boat displacement direction. A plurality of blades projecting radially from a hub of the propeller can rotate about respective blade axes perpendicular to the drive axis. Normally a low-pitch setting, with the generally flat blades almost in a plane perpendicular to the drive axis, is used for high-speed travel while for lower-speed travel a much steeper pitch is employed, with the blades extending at a large acute angle to the plane.

The standard internal-combustion marine engine, which is often a diesel, has a drive curve with a relatively narrow rpm (rev/min) range in which it is highly efficient. The beauty of a variable pitch propeller in combination with such an engine is therefore that it can be set to transmit the maximum force to the water while allowing the engine to continue to run at its most efficient speed. This eliminates the need for a transmission between the blade and the propeller.

Thus as described in German patent 3,901,137 filed 17 Jan. 1989 by P. Mueller et al it is standard to connect a double-acting hydraulic actuator via a linkage with the blades of the propeller. A control system compares the actual engine speed with a preferred speed and is connected to a four-way valve between the compartments of the actuator and both sides of a pump. When the actual motor speed exceeds the desired set point, one of the compartments is pressurized and the other depressurized to increase the pitch and, therefore, the torque the water will exert on the propeller, and when the actual motor speed falls below the set point the compartments are oppositely connected to decrease the pitch of the propeller.

Such a system is fairly complex. Its many hydraulic lines and valves are prone to failure and need frequent servicing, especially in the harsh environment of a watercraft. Furthermore the chambers of the double-acting cylinder are continuously maintained under pressure so that the control system is, in effect, working at all times, even when the blade angle is perfect so that the torque with which the propeller resists rotation exactly equals the engine output torque.

OBJECTS OF THE INVENTION

It is therefore an object of the present invention to provide an improved marine-drive control system.

Another object is the provision of such an improved marine-drive control system which overcomes the above-given disadvantages, that is which automatically sets the pitch of the propeller and which is fairly simple.

SUMMARY OF THE INVENTION

A marine drive has according to the invention a propeller rotatable about a drive axis and having a plurality of blades themselves pivotable about respective blade axes projecting generally radially from the drive axis and each movable between a low-pitch end position extending generally parallel to a plane perpendicular to the drive axis and a high-pitch end position extending at a large acute angle to the plane. An engine rotates the propeller about the drive axis at a variable drive speed in a forward rotation direction. The blade axes are so positioned relative to the respective blades that on forward rotation of the propeller the blades are urged into one of their end positions. A single-acting hydraulic actuator connected to the blades has a compartment pressurizable to displace the blades into the other of the end positions. A source of fluid under pressure has a high-pressure side connected to a controller that is also connected to the compartment and that compares actual engine speed with a desired engine speed and for pressurizing the compartment from the high-pressure side of the source when the actual engine speed varies to one side of the desired engine speed. A conduit connected between the low-pressure side of the source and the compartment continuously drains the compartment to the low-pressure side of the source.

This system is extremely simple because the hydraulic actuator need merely work in one direction on the propeller blades. Movement in the other direction, normally toward the low-pitch position, is primarily effected by the resistance of the water to the blades and is permitted by the leak path along the conduit from the compartment of the actuator. This system therefore eliminates the complexities of a double-acting control system while achieving equally sensitive adjustment.

As mentioned, the one position into which the blades naturally move is the low-pitch position. Thus as the engine is started, the propeller will be in the minimum-pitch position, but as the speed lever is pushed over by the boat operator, the engine speed will rise and the propeller pitch will increase. Once the boat is up to speed, the engine speed will remain constant while the control system will feather the propeller blades to keep this speed within the desired range, which according to the invention can be about 20rev/min wide.

In accordance with this invention the conduit is provided with a flow restriction. In a simple embodiment the actuator has a piston and a cylinder and the restriction is a labyrinth seal between the piston and the cylinder.

According to a further feature of this invention the controller includes an electromagnetically operable shutoff valve connected between the high-pressure side and the compartment. Furthermore a spring is provided for urging the blades into the one end position. This spring can be braced between the piston and cylinder it slides in.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
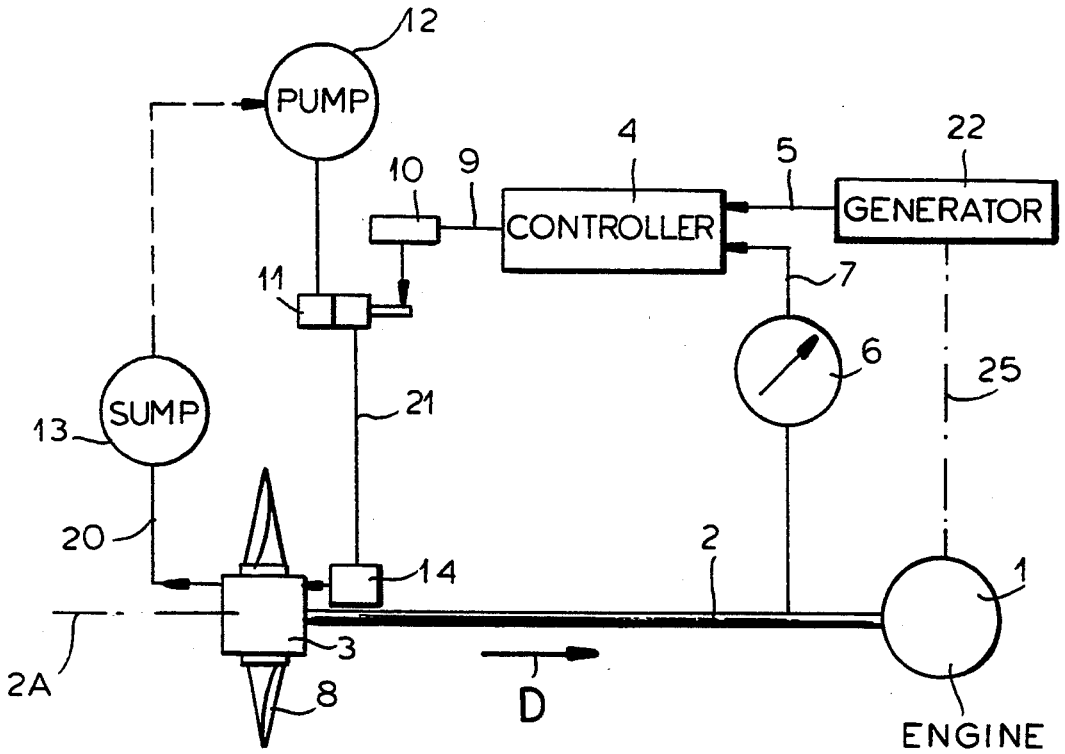
FIG. 1 is a schematic diagram of the drive system of this invention.

As seen in FIG. 1 a marine drive system has a diesel internal-combustion engine 1 having an output shaft 2 connected to a propeller hub 3 to rotate same about a drive axis 2A. A controller 4, typically an electronic microprocessor, receives a desired-speed input on a line 5 from a generator 22, which can be the speed-control lever for the engine 4 as shown by dot-dash linkage 25, and also receives an actual-speed input on a line 7 from a tachometer 6 connected to the engine-output shaft 2.

The propeller hub 3 carries a plurality of vanes 8 whose angular positions as described below can be controlled by a hydraulic actuator 14 that is pressurized from a line 21 in turn pressurized via a valve 11 that is fed high-pressure fluid from the high-pressure side of a pump 12 that has a low-pressure side constituted by a sump or reservoir 13. The controller 4 compares the desired-speed input received at the input line 5 with the actual-value input received on the input line 7 and produces on a line 9 an output that is fed to a pulse generator 10 that operates the valve 11.

Figure 2:
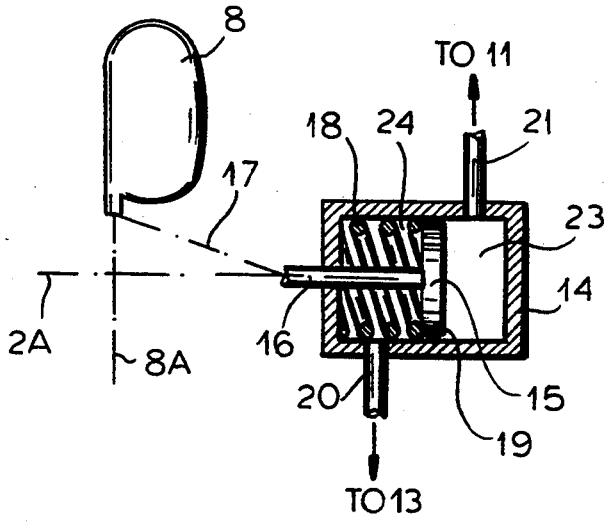
FIG. 2 is a schematic and partly sectional view of details of the drive system.

The vanes 8 as shown in FIG. 2 are pivotal about respective axes 8A that extend perpendicular to the axis 2A and that are so positioned relative to the blades 8 that all forces effective angularly on these blades 8 will pivot them in one direction, here toward a minimum-pitch position with the flat blades lying virtually in a plane perpendicular to the axis 2A. This is most easily done by positioning the blade axes 8A at the leading edges of the blades 2, relative to the normal forward direction of rotation of the hub 3.

The actuator 14 has a piston 15 whose piston rod 16 is connected by an unillustrated linkage 17 to these blades 8 to rotate them oppositely, that is into the illustrated position of maximum pitch extending at a large acute angle to a plane perpendicular to the axis 2A. A spring 18 urges the piston 15 and blades 8 in a direction minimizing the blade pitch.

The piston 15 is sealed in the actuator 14 by a labyrinth seal 19 that permits limited leakage from the compartment 23 into a back compartment 24 which is in turn connected via a line 20 to the sump 13. This actuator assembly 14 is here shown schematically; actually it can be integrated right into the propeller hub as described in my copending application Ser. No. 08/126,082 filed 23 Sep. 1993.

Thus in practice the engine 1 rotates the propeller 3, 8 about the axis 2A so that the force of the water on the blades 8 urges them into the minimum-pitch end position. At the same time the controller 4 is comparing the actual engine speed (on line 7) with the desired engine speed (on line 5). If, for example at low speed (measured by movement of the boat generally in direction D parallel to the axis A) the resistance of the water to the propeller 3, 8 with the blades 8 at this minimum-pitch position is very little, the actual engine speed will substantially exceed the desired engine speed. In this case the controller 4 will operate the pulse generator 10 to periodically open the valve 11 and thereby pressurize the compartment 23, thereby shifting the blades about their axes 8A into positions of greater pitch. Of course as the blade pitch increases, the water resistance will also normally increase and the torque with which the propeller 3, 8 resists rotation will increase, slowing down the actual engine speed. Once the actual engine speed is generally equal to the desired engine speed, the controller will stop pressurizing the compartment 23.

Meanwhile, however, the liquid in the compartment 23 is leaking past the restriction constituted by the labyrinth seal 19 to the low-pressure sump 13. The force of the water on the blades 8 plus the force of the spring 18 directly on the piston 15 will therefore cause the blades 8 to pivot toward their low-pitch position. This will of course cause the actual engine speed to creep up until it exceeds the desired engine speed, at which time the controller 4 will correct again by feeding some more pulses of fluid to the actuator 14.

If the boat operator cares to stop the boat, he or she merely resets the speed-control 22 to drop the desired engine speed to the idle level. The leak path formed by the restriction 19 and the conduit 20 will then automatically reduce the propeller pitch 8.

In order to prevent excessive hunting, that is constant adjustment of the blades 8 by the controller 4, the controller 4 normally is set to allow some variation, typically about 20 rev/min between the desired and actual engine speeds without making any correction. This range can be changed for a sport boat used in open waters where the prop might jump out of the water completely. In this case the controller 4 is provided with a circuit which calculates from extreme differences between actual and desired motor speed and their durations a time-limited virtual desired value for the motor speed which is used.

I claim:

1. A marine drive comprising:

a propeller rotatable about a drive axis and having a plurality of blades themselves pivotable about respective blade axes projecting generally radially from the drive axis and each movable between a low-pitch end position extending generally parallel to a plane perpendicular to the drive axis and a high-pitch end position extending at a large acute angle to the plane;

drive means including an engine connected to the propeller for rotating the propeller about the drive axis at a variable drive speed in a forward rotation direction, the blade axes being so positioned relative to the respective blades that on rotation of the propeller about the drive axis in the forward direction the blades are urged into one of their end positions;

a single-acting hydraulic actuator connected to the blades and having a compartment pressurizable to displace the blades into the other of the end positions;

a source of fluid under pressure having a high-pressure side and a low-pressure side;

control means connected to the engine, to the high-pressure side of the source, and to the compartment for comparing actual engine speed with a desired engine speed and for pressurizing the compartment from the high-pressure side of the source when the actual engine speed varies to one side of the desired engine speed; and conduit means connected between the low-pressure side of the source and the compartment continuously draining the compartment to the low-pressure side of the source.

2. The variable-pitch marine drive defined in claim 1 wherein the one position is the low-pitch position.

3. The variable-pitch marine drive defined in claim 1 wherein the conduit means is provided with a flow restriction.

4. The variable-pitch marine drive defined in claim 3 wherein the actuator has a piston and a cylinder and the restriction is a labyrinth seal between the piston and the cylinder.

5. The variable-pitch marine drive defined in claim 1 wherein the control means includes an electromagnetically operable shutoff valve connected between the high-pressure side and the compartment.

6. The variable-pitch marine drive defined in claim 1, further comprising spring means urging the blades into the one end position.

7. The variable-pitch marine drive defined in claim 6 wherein the actuator has a piston and a cylinder and the spring means is a spring braced between the piston and cylinder.

8. The variable-pitch marine drive defined in claim 1 wherein the control means has a tolerance range in which it permits the actual engine speed to vary from the desired engine speed without pressurizing the compartment.

9. The variable-pitch marine drive defined in claim 1 wherein the one end position is the low-pitch position and the control means only pressurizes the compartment when the actual engine speed exceeds the desired engine speed.

* * * * *